US005816683A

United States Patent [19]

Christiansen

[11] Patent Number: 5,816,683

[45] Date of Patent: Oct. 6, 1998

[54] FLASHLIGHT ADAPTER FOR A HANDGUN

[76] Inventor: Ned F. Christiansen, 55017 Flatbush Rd., Three Rivers, Mich. 49093

[21] Appl. No.: 813,565

[22] Filed: Mar. 7, 1997

[51] Int. Cl.[6] ..... F41G 1/34

[52] U.S. Cl. ..... 362/110; 362/114; 42/103

[58] Field of Search ..... 362/110, 114; 42/103

[56] References Cited

U.S. PATENT DOCUMENTS

| | | | |
|---|---|---|---|
| 1,215,171 | 2/1917 | Lewis . | |
| 1,262,270 | 4/1918 | Schmidt et al. . | |
| 2,209,524 | 7/1940 | Key . | |
| 2,236,736 | 4/1941 | Scott . | |
| 3,106,348 | 10/1963 | Robinson . | |
| 4,542,447 | 9/1985 | Quakenbush . | |
| 4,758,933 | 7/1988 | Winberg et al. . | |
| 4,777,754 | 10/1988 | Reynolds, Jr. . | |
| 5,040,322 | 8/1991 | Iturrey, Jr. . | |
| 5,167,446 | 12/1992 | Haroutunian . | |
| 5,177,309 | 1/1993 | Willoughby et al. . | |
| 5,557,872 | 9/1996 | Langner | 362/114 |
| 5,560,703 | 10/1996 | Capps, III | 362/110 |
| 5,628,555 | 5/1997 | Sharrah et al. | 362/114 |

OTHER PUBLICATIONS

Article from *Law and Order,* May 1996, p. 137 (1 page).

*Primary Examiner*—Thomas M. Sember

*Attorney, Agent, or Firm*—Flynn, Thiel, Boutell & Tanis, P.C.

[57] ABSTRACT

A flashlight adapter for a handgun having a base retainer receivable into the interior of a magazine through a distal end thereof. A spring biases the base retainer toward the distal end. The magazine has a flange about the distal end of the magazine. A magazine base is removably engaged on the flange and is secured in its assembled position by protuberances extending from the base retainer being received in apertures in the magazine base. The magazine base has a channel therein for receiving a lightholder for holding a flashlight therein. The lightholder is selectively received within the magazine base.

15 Claims, 5 Drawing Sheets

FLASHLIGHT ADAPTER FOR A HANDGUN

FIELD OF THE INVENTION

This invention relates to a flashlight adapter for a handgun and, more particularly, to a flashlight adapter for a handgun for use with a handgun magazine which is easily removable from the magazine when the flashlight is not needed.

BACKGROUND OF THE INVENTION

For many years, light producing devices for use with handguns have been provided to improve the safety when using a handgun in a low light or night time environment. Prior attempts at suitable solutions for providing a light on a handgun required the securing of a specially manufactured light to the barrel of a handgun by clamps which secure the light onto the barrel of the gun. The power for the light is provided by a battery secured in the handle or stock. Wires were externally present on the handgun and the handle was bored out to insert a battery therein. Examples of prior apparatus for securing a light to a gun are U.S. Pat. Nos. 1,215,171, 1,262,270, 2,236,736, 4,542,447, 4,777,754 and 5,040,322. Many clamp devices must be permanently attached and are not quickly and efficiently removable when not needed, for example during the day time, or when it is desired to hold the handgun and flashlight separately or during loading and unloading the handgun. Further, attaching the light to the barrel may interfere with the user's aim of the gun by altering the weight of the barrel. Modern handguns require a magazine containing the bullets to be inserted into the handle. Therefore, the battery cannot be placed in the handle and the light and attachment apparatus cannot interfere with the removal and insertion of the magazine.

Another type of device has a handle with a notch therein against which a flashlight may be held. This type of device is disclosed in U.S. Pat. No. 4,758,933. This type of lightholder requires the user to use two hands to hold the flashlight in the notch and grip the gun handle at the same time and a specially modified handle for the handgun. Further, a removal of one of the hands may cause the user to drop the flashlight. U.S. Pat. No. 5,167,446 discloses a similar device which provides a holder which is attached to the light and is held against the handle. These types of devices interfere with the standard two-handed grip commonly utilized by law enforcement officers.

U.S. Pat. Nos. 2,209,524 (Key) and 3,106,348 (Robinson) disclose attaching a lightholder to the handle of a handgun. The lightholder of Key has a semicircular flashlight-engaging part and a handle-engaging part. The handle-engaging part has two configurations with the first configuration being a C-shaped slot which engages a bar extending between added side plates to support a rearward end of the lightholder. The side plates are added to each side of the handle. A hand-engaging part of the lightholder is positioned adjacent the handle and must be held by the user to secure the lightholder. The second configuration of the handle-engaging part has a plate which is inserted between the handle and one of the additional side plates to fixedly secure the lightholder on the handgun. Robinson also has a handle-engaging part which is fixedly secured to the handle to which the light-engaging part is held. The lightholder of Robinson extends the flashlight entirely forwardly from the bottom of the handle which will disrupt the balance of the handgun when in use.

U.S. Pat. No. 5,177,309 discloses laser modules having a sufficiently small size to be inserted into an expanded end plate of a magazine. These types of laser modules are expensive. The laser modules require a special end plate to attach them to a magazine and are not easily removable from the magazine. It is an object of the invention to provide a removable lightholder for removably securing a conventional flashlight onto standard handguns, in particular, to the magazine of the handgun.

It is a further object of the invention to provide a means for quick and easy release of the lightholder and flashlight from the magazine so that the magazine operates without the flashlight and the flashlight may be operable separate from the handgun and magazine.

A still further object of the invention is to provide the lightholder and flashlight which minimally disturbs the balance of the handgun.

Another object of the invention is to provide a flashlight adapter which secures the flashlight to the handgun so that the flashlight does not move relative to the handgun during the recoil created when firing the handgun.

SUMMARY OF THE INVENTION

The objects and purposes of the invention have been met by providing a flashlight adapter for a handgun having a base retainer receivable within a magazine of a handgun, the magazine base retainer and magazine locking a magazine base onto the magazine, a lightholder being removably mounted on the magazine base to selectively secure a flashlight to the magazine base, and, hence, to the magazine and handgun.

BRIEF DESCRIPTION OF THE DRAWINGS

Further objects and purposes of the invention will become apparent to persons acquainted with flashlight adapters for handguns by referencing the following text and accompanying drawings, in which.

Figure 1:
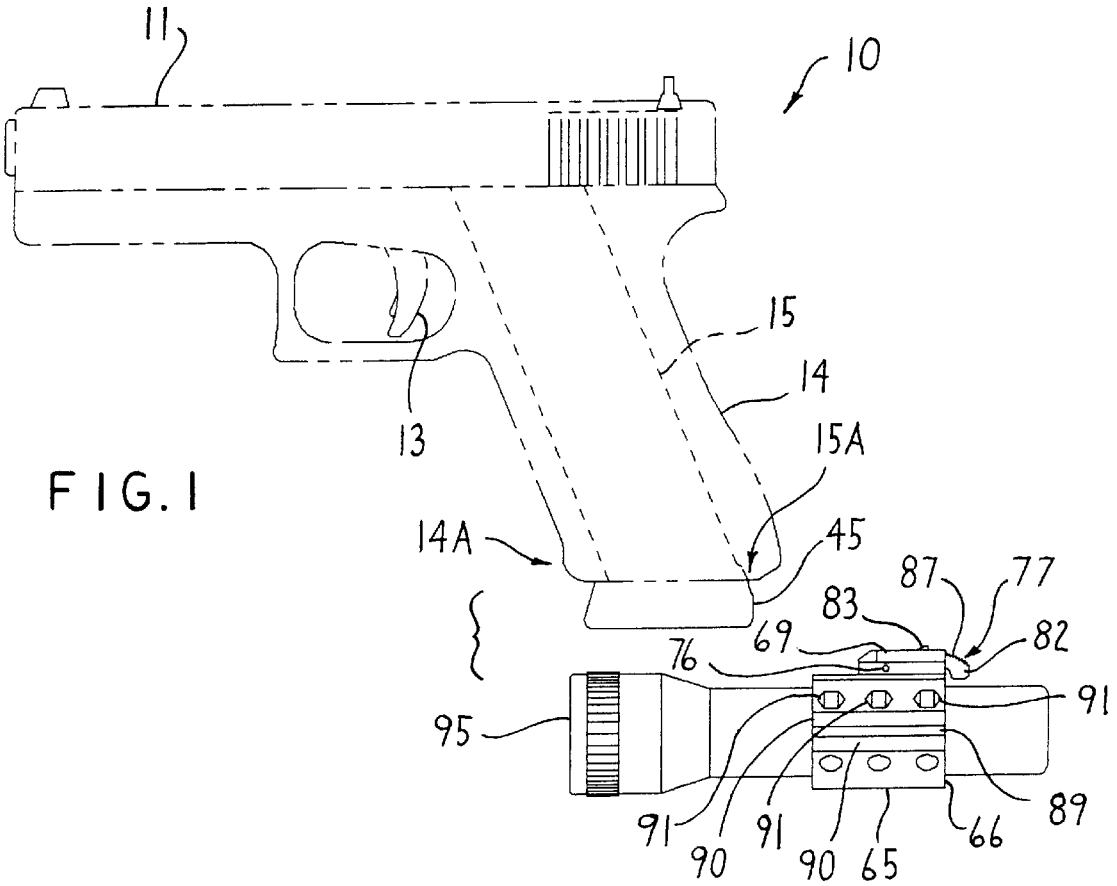
FIG. 1 is an elevational view showing a handgun and my inventive flashlight adapter and a flashlight attached thereto.
Figure 2:
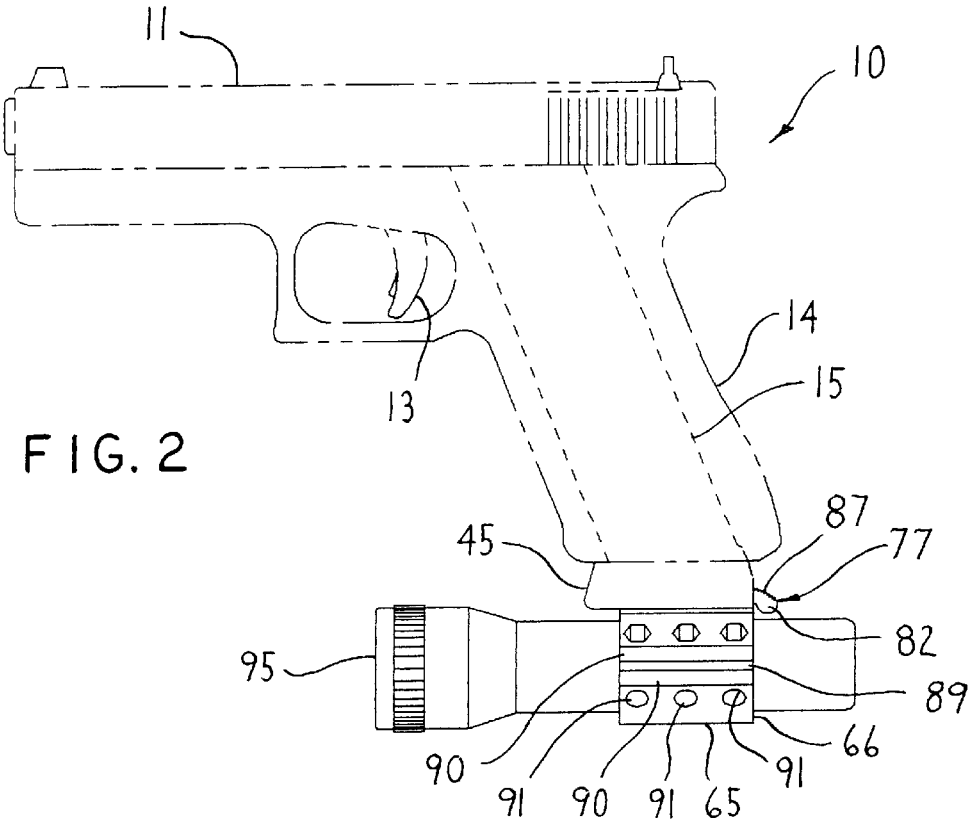
FIG. 2 is a view similar to FIG. 1 but showing the flashlight adapter secured to a magazine of the handgun.
Figure 3:
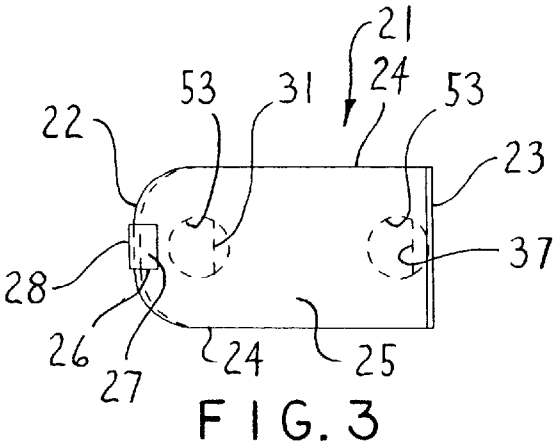
FIG. 3 is a top plan view of the magazine base retainer of my invention.

Certain terminology will be used in the following description for convenience in reference only and will not be limiting. The words "up", "down", "right", and "left" will designate directions in the drawings to which reference is made. The words "front" and "rear" will refer, respectively, to the bullet exiting end of the gun and the opposite end therefrom. Such terminology will include derivatives and words of similar import.

DETAILED DESCRIPTION

In FIG. 1, a standard handgun 10 is shown having a barrel 11, a trigger 13 and a handle or grip 14. The grip 14 of the gun 10 has an open interior for coaxially receiving therein a magazine 15 through a distal end or butt 14A thereof. The magazine 15 has a distal end 15A which is generally positioned adjacent the butt end 14A of the grip 14 when the magazine is fully inserted into the grip 14. The magazine has elongate walls 16 enclosing an open interior 17 which is closed at an end remote from the distal end 15A by a bullet feed portion 18 which facilitates a feeding of the bullets (not shown) into the firing system (not shown) of the handgun 10. The magazine 15 is usually rectangular in cross section and has an outwardly flared flange 19 extending around the distal end 15A about three sides of the magazine 15. A spring 20 is received within the open interior 17 of the magazine 15 which biases the bullets (not shown) upwardly toward the bullet feed portion 18 and biases a magazine base retainer 21 downwardly toward the distal end 15A of the magazine.

The magazine base retainer 21 occupies the cross-sectional entirety of the open interior 17 of the magazine 15 when received therein. The magazine base retainer 21 is generally rectangular in shape and has a front edge 22, rear edge 23 and side edges 24. The front and rear edges 22, 23 are angled so that they are in conformity and close contact with the adjacent side wall 16 of the magazine. The front edge 22 and side edge 24 are joined at rounded corners. The rear edge 23 is essentially perpendicular to the side edges 24. The magazine base retainer 21 has an inwardly facing surface 25 on which the spring 20 is in contact with the magazine base retainer 21 and which faces inwardly into the open interior 17 of the magazine 15 when the magazine base retainer is positioned within the open interior 17 through the open distal end 15A of the magazine 15. A protrusion 26 extends upwardly from the inwardly facing surface 25 into the open interior 17 of the magazine 15 generally axially relative to the magazine and is adapted to prevent the magazine base retainer from moving in a direction led by the front edge 22. The protrusion 26 has a width less than the distance between the side edges 24 of the magazine base retainer 21. The protrusion 26 is defined by an inclined surface 27 extending outwardly from the inwardly facing surface 25 of the magazine base retainer 21 and toward the front edge 22. A front facing surface 28 of the protrusion 26 is joined to and essentially coplanar with the front edge 22 of the magazine base retainer and both are adapted to contact an inwardly facing surface of the walls 16 of the magazine 15. A surface 29 of the magazine base retainer 21 is positioned to face outwardly from the open interior 17 through the distal end 15A of the magazine 15 remote from the inwardly facing surface 25. The inwardly facing surface 25 and the outwardly facing surface 29 are generally parallel to each other. A forwardly positioned protuberance 31 is positioned adjacent the front edge 22 of the magazine base retainer 21 extending generally perpendicular to the outwardly facing surface 29 and axially relative to the magazine 15. The protuberance 31 is defined by an inclined surface 32 extending from the outwardly facing surface 29 adjacent the front edge 22 and both axially and radially relative to magazine 15. A downwardly facing wall 33 of the protuberance 31 is generally parallel to the outwardly facing surface 29 of the magazine base retainer 21 and extends from the inclined surface 32 and ends at a rearwardly facing surface 34 of the protuberance 31. The rearwardly facing surface 34 extends essentially axially with respect to the magazine 15 and perpendicular to the outwardly facing surface 29 of the magazine base retainer 21. A rearwardly positioned protuberance 37 is positioned on the outward facing surface 29 of the magazine base retainer 21 laterally spaced from the forward protuberance 31. The protuberance 37 has an inclined surface 38 extending outwardly from the outward facing surface 29 and radially and axially relative to the magazine 15 and the inclined surface 38 also extending rearwardly relative to magazine 15. The inclined surface 38 extends from the outward facing surface 29 at a reduced angle measured from the surface 29 compared to an angle of the inclined surface 32 of protuberance 31 measured from the surface 29. A downwardly facing wall surface 39 extends generally parallel to the surface 29 from the end of the inclined surface 38 and is positioned closer to the surface 29 than the downwardly facing wall surface 33 of the first mentioned protuberance 31. A rear wall surface 41 extends perpendicular to the outward facing surface 29 between the top wall surface 39 and surface 29. The rear wall 41 is adjacent the rear edge 23 of the magazine base retainer 21 spaced a short lateral distance inwardly from the edge 23. The protuberances 31, 37 have widths less than the distance between the side edges 24 of the magazine base retainer 21. The forward oriented protuberance 31 has a height measured from the outward facing surface 29 greater than the height of the rearward oriented protuberance 37 measured from the same surface, or, in other words, the downwardly facing wall surfaces 33 and 39 occupy different horizontal planes.

Figure 4:
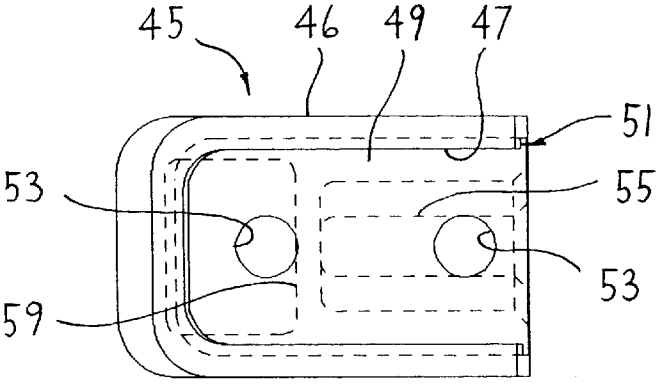
FIG. 4 is a top plan view of a magazine base of my invention.
Figure 5:
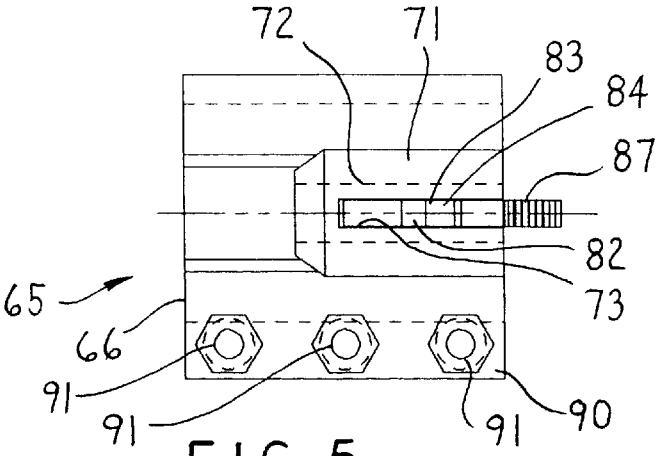
FIG. 5 is a top plan view of the lightholder of my invention.
Figure 6:
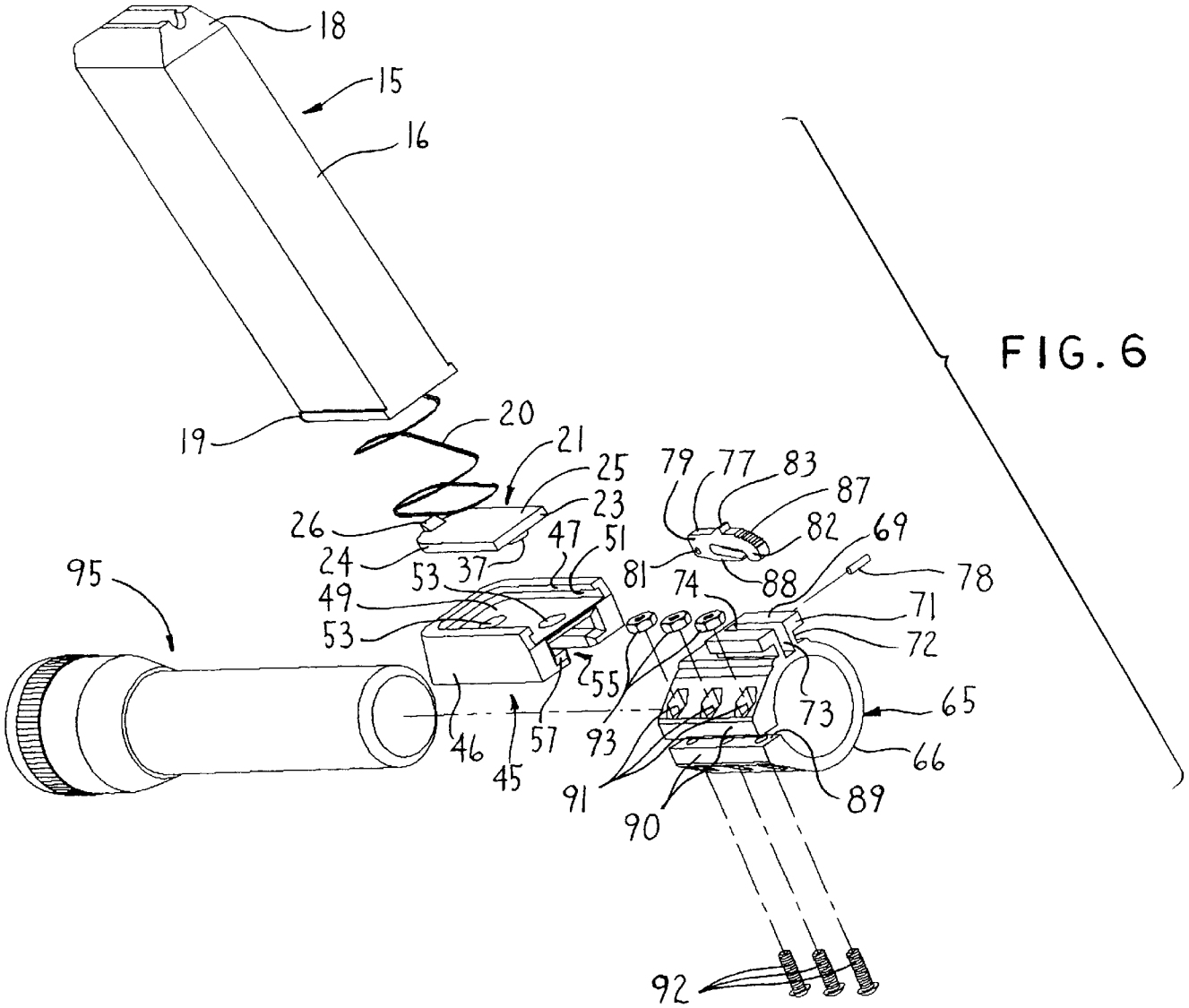
FIG. 6 is an exploded view of my invention.

A magazine base 45, which has an H-shaped configuration in cross section, is removably receivable on the distal end 15A of the magazine 15 and has a generally rectangular shape in a top view (FIG. 4) or bottom view thereof. The magazine base 45 has a U-shaped upstanding side wall 46 which extends around three sides of the rectangular magazine base 45. An inwardly projecting flange 47 is positioned adjacent an upper edge of the upright side wall 46. The magazine base 45 also has a plate member 49 extending generally perpendicular to the upright side wall 46 below the flange 47 and covering substantially the internal rectangular extent of the region inside the side walls 46 and the magazine base 45. A channel 51 is defined between the flange 47, upright member 46 and plate 49 and conforms in shape and size to receive the flange 19 of the magazine 15 therein. The plate 49 has a pair of detents or apertures 53 generally extending therethrough and being front to back spaced from each other. The apertures 53 have a width slightly greater than the width of the protuberances 31, 37 with one edge of each aperture 53 being respectively positioned in a snug relationship to the rear wall surfaces 34, 41 when the magazine base 41 is positioned on the magazine 15. The magazine base 45 has a guide track, here a T-shaped channel 55, extending partially through the longitudinal extend thereof. The T-shaped channel 55 is defined by the plate 49, upright side wall 46, and a flange 57 extending generally transverse to the lower edge portion of the upright side wall 46 and inwardly relative to the side wall 46 and the magazine base 45. The magazine base 45 and the T-shaped channel 55 have open ends on the same rearward side of the magazine base lacking the upright side wall 46. An intermediate upright member 59 extends between the laterally spaced portion of upright side wall 46 centrally within the magazine base 45 thereby acting as a front end wall of the T-shaped channel 55. The T-shaped channel 55 is open at its rear end remote from the intermediate upright member 59.

A lightholder 65 is adapted to be removably received within the T-shaped channel 55 of the magazine base 45. More specifically, the lightholder 65 has a guide part, here a T-shaped member 69, extending radially outwardly from a cylindrical body 66 of the lightholder 65. The T-shaped member 69 extends over a majority of the longitudinal length of the body 65 and has a crosswise extending piece 71 positioned on an end of a stem 72 of the T-shaped member remote from the cylindrical body 66. A groove 73 extends through the longitudinal extent of the T-shaped member 69 through the crosswise extending piece 71 and the stem 72, however, an end wall 74 closes the groove 73 at one end thereof. Crosswise extending and axially aligned apertures 76 are positioned within the stem 72 adjacent and rearwardly of the wall 74 of the groove 73. An elongate lightholder latch 77 is receivable within the groove 73. The lightholder latch 77 is generally U-shaped with the bight section 79 thereof having an aperture 81 therethrough for receiving a lightholder latch pin 78. The lightholder latch pin 78 extends through the bight section with the ends of the pin 78 being received in the aligned apertures 76 in the stem 72 thereby allowing pivotable movement of the lightholder latch within the groove 73. A leg 82 of the U-shaped lightholder latch 77 adjacent the cross piece 71 remote from the cylindrical body 66 of the lightholder 65 has a tooth 83 extending outwardly of the groove 73 at generally a right angle to the longitudinal axis of the leg 82. The tooth 83 has an inclined surface 84 extending outwardly from an upwardly facing surface of the leg 82 toward the open end of the groove 73. A rearwardly facing surface 85 extends generally perpendicularly to the length of the leg 82 and joins the inclined surface 84 through a top surface 86 of the tooth 83 which extends generally parallel to the longitudinal axis of the leg 82. The leg 82 is generally rigid and extends beyond a lateral edge of the lightholder 65. An upwardly facing surface of the leg 82 is serrated as at 87 to provide a greater frictional contact between a user's finger and the leg 82. The other leg 88 of the U-shaped lightholder latch 77 is a resilient leg which is deformable by a user depressing the leg 82. The resiliently or elastically yieldable leg 88 presses against an outward surface of the cylindrical body 66 at bottom wall of the groove 73. The latch 77 is movable between first and second positions against the spring force provided by the leg 88.

At a side of the lightholder 65, the side of which is defined as about 90° displaced from the T-shaped member 69, the wall of the cylindrical body 66 has a break 89 therein, whereat outwardly extending flanges 90 are provided adjacent both sides of the break 89 and through which plural aligned holes 91 extend. The holes 91 receive screws 92 and nuts 93 therein which serve to close the break 89 and clamp the cylindrical body 66 about a conventional flashlight 95 inserted into the cylindrical body 66.

OPERATION

Although the operation of the inventive flashlight adapter for a handgun will be understood from the foregoing description by skilled persons, a summary of operation is now given for convenience. To attach the flashlight 95 on to the distal end 15A of the magazine 15 which is, in turn, insertable into the grip 14 of the handgun 10, the magazine base retainer 21 and the magazine base 45 must be attached to the magazine 15. The magazine base retainer 21 is forced into the open interior 17 of the magazine 15 against the force of the spring 20 with the front edge 22 of the protrusion 26 resting against a forwardly oriented wall of the side walls 16 of the magazine and with the inclined surfaces 32 and 38 of the respective protuberances 31, 37 facing toward the front wall 16 of the magazine 15. The front edge 22 and rear edge 23 of the magazine base retainer are slightly angled relative to the parallel surfaces 25, 29 such that the edges 22, 23 are in slidable contact with the interior surfaces of the walls 16.

Figure 7:
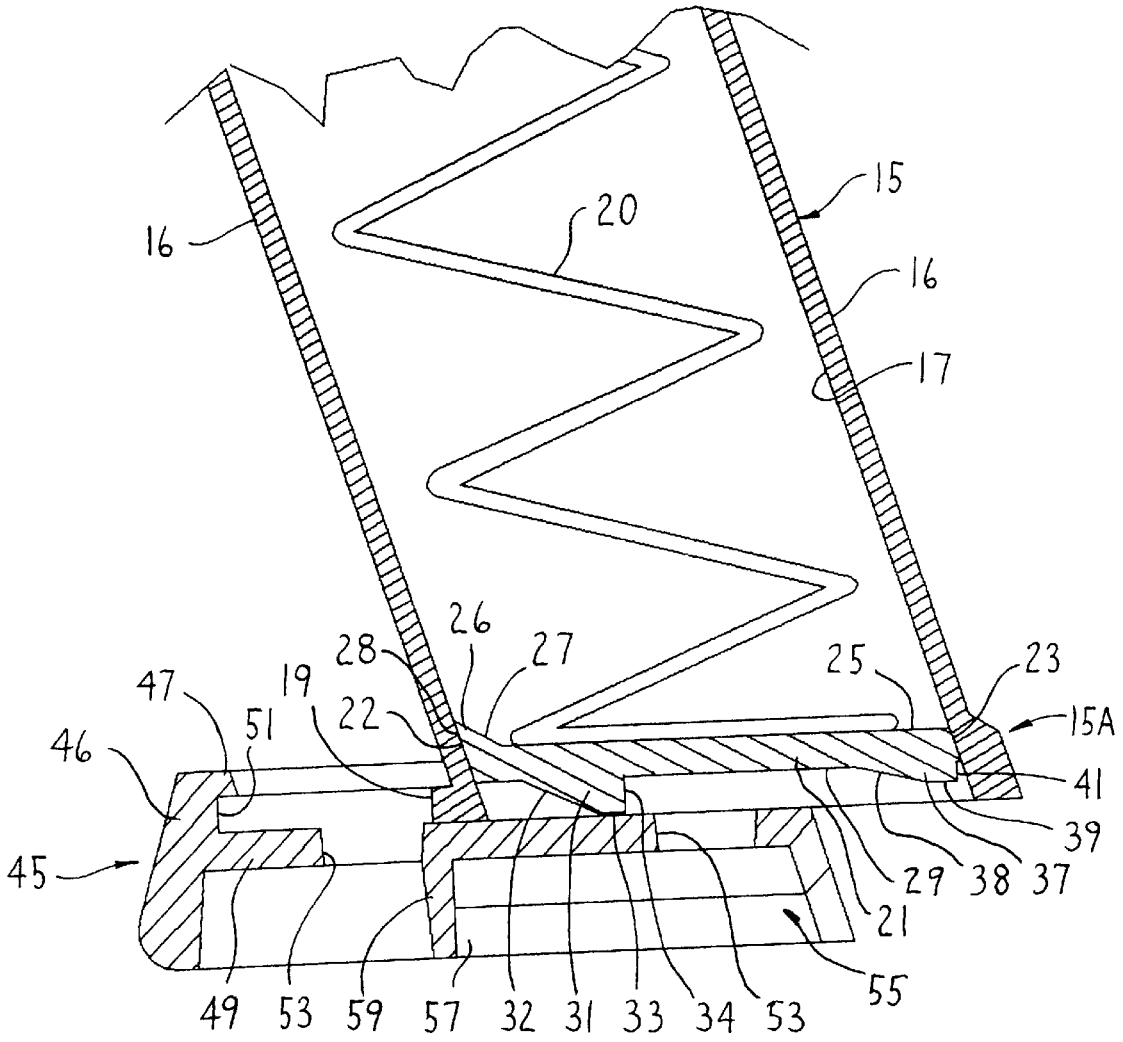
FIG. 7 is a partial and cross-sectional view of the magazine, magazine base retainer, and magazine base.
Figure 8:
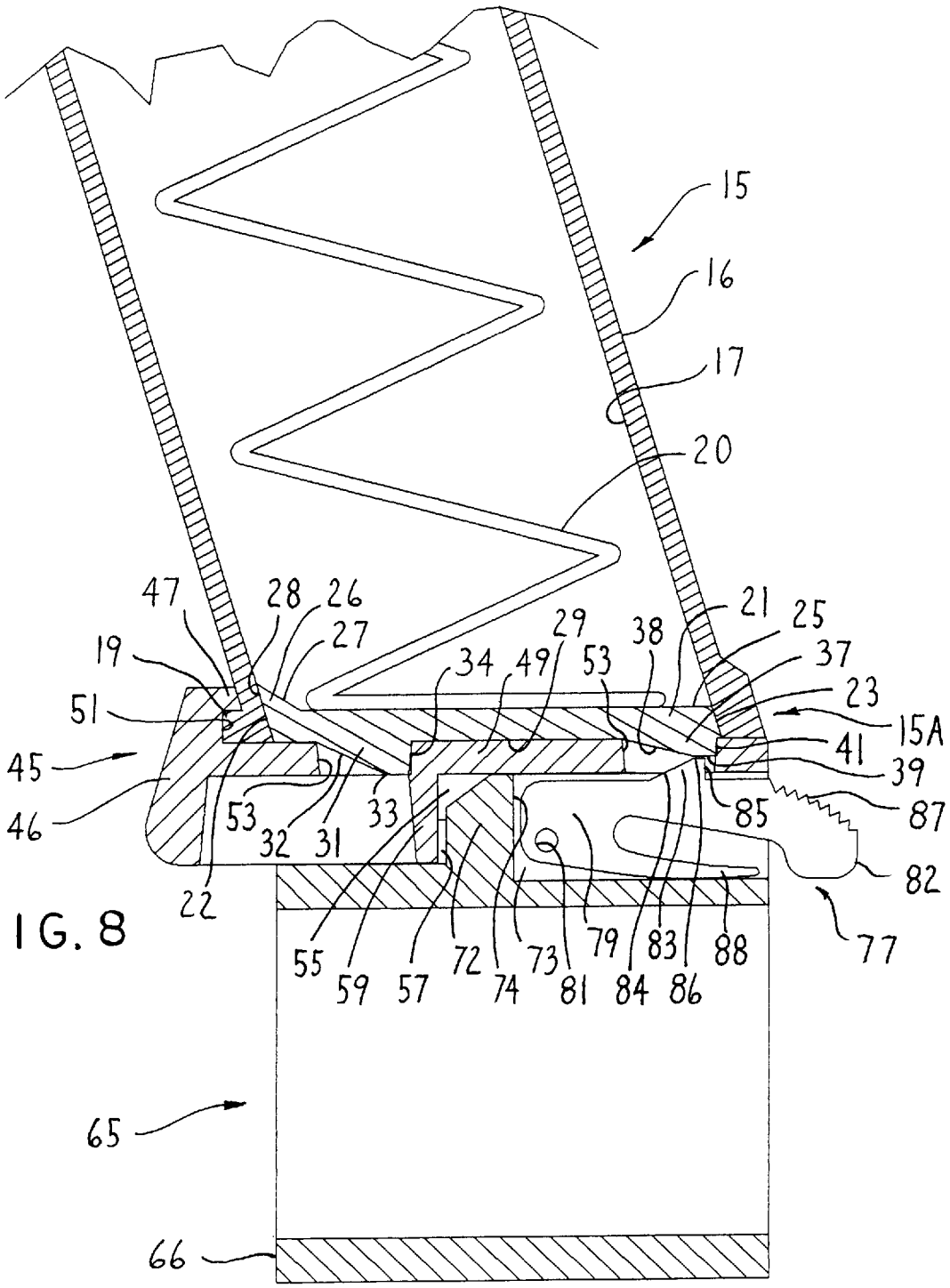
FIG. 8 is a partial and cross-sectional view showing the lightholder partially mounted on the magazine base.

The magazine base 45 is slidable onto the distal end 15A of the magazine 15 with the flange 19 of the magazine being received within the channel 51 of the magazine base 45 through the open end thereof. As the magazine base 45 is slid onto the flange 19, from the left in FIG. 7, the inclined surface 32 of the protuberance 31 contacts an edge of the plate 49 of the magazine base 45 which rides therealong and forces the magazine base retainer 21 against the force of the spring 20 upwardly into the open interior 17 of the magazine 15 until the downwardly facing wall 33 rides on an upwardly facing surface of the plate 49. After the magazine base 45 is slid partially onto the distal end 15A of the magazine 15, the protuberance 31 will fall within one of the apertures 53 in the plate 49. A continued sliding of the magazine base 45 causes the inclined surface 32 of the protuberance 31 to contact a side of the aperture 53 and this again displaces the magazine base retainer 21 upwardly into the interior 17 of the magazine 15 against the force of the spring 20 until the downwardly facing wall 33 can ride atop the inwardly facing surface of the plate 49. When the magazine base 45 is fully inserted onto the distal end 15A of the magazine 15, the protuberance 31 falls into the forward-oriented aperture 53 such that the rear facing wall surface 34 of the protuberance 31 extends into the aperture 53 and is in close contact to an edge of the aperture 53 thereby preventing movement of the magazine base 45 in a direction opposite the direction of insertion onto the magazine even when the handgun is fired. At the same time as the protuberance 31 falls within the forward aperture 53, the other protuberance 37 also falls within the rearward-oriented aperture 53 and the rear wall surface 41 thereof is in close contact to an edge of the rearward-oriented aperture 53 which also prevents a lateral movement of the magazine base 45, as shown in FIG. 8, even when the handgun is fired. When the magazine 15, magazine base retainer 21 and magazine base 45 are one assembled unit, the magazine may be inserted into the grip 14 thereby loading the gun with ammunition.

The lightholder 65 may now be inserted onto the distal end 15A of the magazine 15 by joining the lightholder 65 to the magazine base 45. It is preferable that the lightholder has a conventional flashlight 95 inserted into the cylindrical body 66 prior to joining the lightholder 65 to the magazine base 45. The guide part or T-shaped member 69 of the lightholder 65 is selectively receivable within the guide track or T-shaped channel 55 within the magazine base 45. The T-shaped member 69 is slid into the T-shaped channel 55 in a direction opposite the direction of insertion of the magazine base 45 onto the magazine 15. The crosswise extending piece 71 rests upon the flange 57 when the light holder 65 is received within the magazine base 45 on the T-shaped channel 55 receives the T-shaped member 69. When the T-shaped member 69 is partially received within the T-shaped channel 55, the inclined surface 84 of the tooth 83 contacts a rearmost edge of the plate 49 which forces the lightholder latch 77 downwardly by deforming the resilient leg 88. The lightholder latch 77 is now in a position allowing the lightholder 65 to slidably move into the magazine base 45. When the lightholder 65 is fully inserted, the tooth 83 will snap under the urging of the elastically yieldable leg 88 upwardly into the rearward-oriented aperture 53 which also receives the protuberance 37 therein. The lightholder latch 77 is now in a position securing the lightholder 65 onto the magazine base 45 by preventing movement in a direction opposite the direction of insertion thereof. There is room within the rearward-oriented aperture 53 for the tooth 83 to extend therein because the protuberance 37 is not as tall as the forward protuberance 31, thus both the protuberance 37 and tooth 83 fit within the same aperture 53. The generally perpendicular rear surface 85 of the tooth of the lightholder latch 77 prevents the lightholder 65 from sliding in a direction opposite the direction of insertion by contacting an edge of the aperture 53. The stem 72 prevents the lightholder 65 from continuing to slide in the direction of insertion by contacting the intermediate wall 59 of the magazine base 45.

The lightholder 65 and flashlight 95 are secured to the distal end 14A of the grip 14 and remain so regardless of the positioning of the handgun 10. The flashlight 95 is aligned longitudinally with the barrel 11 so that the beam of light from the flashlight 95 extends in the targeting direction and is generally evenly balanced on the handle 14.

To quickly and efficiently remove only the lightholder 65 and flashlight 95 from the distal end 14A of the grip 14, the user depresses the leg 82 preferably at the serrations 87 thereby resiliently or elastically deforming the other leg 88 thereby removing the tooth 83 from the aperture 53 and changing the position of the latch 77. The lightholder 65 is then slid in a removing direction opposite the insertion direction thereof until the T-shaped member 69 is removed from the T-shaped channel 55. The gun 10 may then be used without the flashlight 95 and lightholder 65 thereon or the flashlight may be used separately from the handgun.

The magazine base 45 and magazine base retainer 21 must be removed to access the interior 17 of the magazine 15. To remove the magazine base 45, the magazine base retainer 21 is displaced longitudinally into the interior 17 of the magazine 15 by a user, by using a two pronged tool inserted into both of the apertures 53, contacting the protuberances 31, 37 and displacing the magazine base retainer 21 against the force of the spring 20. Once both protuberances 31, 37 are removed from the apertures 53, the magazine base 45 may be partially slid off of the flange 19 on the distal end 15A of the magazine 15 in the direction opposite the direction of insertion of the magazine base 45. Once the magazine base 45 is partially removed, the downwardly facing wall surfaces 33, 39 will ride on the plate 49 of the partially removed magazine base 45 until the aperture 31 falls into the other aperture 53 which received the protuberance 37 in the assembled state. The protuberance 31 must again be displaced upwardly into the interior 17 of the magazine 15 until the protuberance 31 clears the upper surface of the plate 49 and the magazine base 45 is then slid completely off of the flange 19.

Although a particular preferred embodiment of the invention has been disclosed in detail for illustrative purposes, it will be recognized that variation or modification of the apparatus including the rearrangement of parts lie within the scope of the present invention.

The embodiments of the invention in which an exclusive property or privilege is claimed are defined as follows:

1. In a flashlight adapter for a handgun, the handgun having a grip in which a magazine is received, the magazine having an open interior, an open distal end, and a spring housed therein, the improvement comprising, a base retainer received in the magazine distal end and the interior of the magazine, the base retainer having first and second ends abutting opposing walls defining the open interior of the magazine, the base retainer additionally having a first surface facing into the interior of said magazine and being engaged by the spring to continually urge the base retainer toward the magazine distal end;

a magazine base releasably coupled to the magazine distal end and base retainer and having means thereon defining a guide track and means thereon defining a detent, both facing away from the magazine distal end; and a holder member for holding a flashlight thereon removably received on the magazine base, the holder member and magazine base having operatively engaged latch means for securing the holder member to the magazine base, the holder member including a guide part slidably received on the guide track to support the holder member on the magazine base, the holder member additionally including a movable holder latch member selectively engaging the detent on magazine base, when in the first position thereof, so as to selectively secure the holder member to the magazine base and selectively disengaging the detent, when in the second position thereof, to facilitate removal of the guide part of the holder member from the guide track of the magazine base.

2. The flashlight adapter for a handgun according to claim 1, wherein the base retainer generally extends throughout the entirety of an area of the open interior of the magazine.

3. The flashlight adapter for a handgun according to claim 1, wherein the base retainer has at least one protuberance extending generally axially relative to the magazine from a second surface thereof when the base retainer is within the interior of the magazine, the second surface of the base retainer being remote from the first surface thereof, and wherein the magazine base has at least one aperture which respectively receives the at least one protuberance therein when the spring presses the base retainer toward the magazine distal end so as to prevent a slidable disengagement of the magazine base from the magazine distal end.

4. The flashlight adapter for a handgun according to claim 3, wherein a surface of the at least one protuberance is in close contact to an edge of the at least one aperture, whereby the magazine base is essentially prevented from moving relative to the handgun during recoil thereof.

5. The flashlight adapter for a handgun according to claim 3, wherein the magazine has a magazine flange extending radially from the magazine distal end, and wherein the magazine base has a wall member, a plate extending transverse the wall member, and a base flange extending transverse the wall member defining a channel therebetween, the channel slidably receiving the magazine flange therein to secure the magazine base on the magazine, and wherein the apertures in the magazine base are positioned in the plate.

6. The flashlight adapter for a handgun according to claim 5, wherein the base retainer has a protrusion means for preventing a front to back movement of the base retainer when slidably removing the magazine base, the protrusion means extending generally axially relative to the magazine from the first surface of the base retainer.

7. The flashlight adapter for a handgun according to claim 5, wherein the magazine base has an intermediate wall extending between two opposing sides of the wall member and is front to back spaced from a third side of the wall member, wherein the wall member has a lightholder flange extending from an edge of the wall member remote from the base flange, the wall member, the plate, and the lightholder flange defining an elongate T-shaped channel for receiving the lightholder therein, the intermediate wall closing an end of the T-shaped channel, and wherein the lightholder has an elongate T-shaped member receivable in the T-shaped channel.

8. The flashlight adapter for a handgun according to claim 7, wherein the T-shaped member has a stem, a crosspiece positioned on the stem, and a groove extending into the stem of the T-shaped member through the crosspiece of the T-shaped member, and wherein the lightholder latch is pivotally secured in the groove to latch the T-shaped member in the T-shaped channel adjacent the intermediate wall.

9. The flashlight adapter for a handgun according to claim 8, wherein the T-shaped member has apertures extending transversely therethrough, the lightholder latch has an aperture extending therethrough transverse the longitudinal extent thereof generally aligned with the apertures of the T-shaped member, and a pin extends through the aperture in the lightholder latch and extends into the apertures in the T-shaped member thereby pivotally joining the lightholder latch within the groove.

10. The flashlight adapter for a handgun according to claim 8, wherein the lightholder latch has a tooth extending into one of the two apertures in the magazine base when the T-shaped member is inserted into the T-shaped channel so that the tooth contacts an edge of the one aperture preventing a lateral movement of the lightholder relative to the magazine in a first direction and the intermediate wall prevents a lateral movement of the lightholder relative to the magazine in a second direction.

11. The flashlight adapter for a handgun according to claim 10, wherein the lightholder latch is essentially U-shaped an has a bight section joining first and second legs, the first leg being generally rigid, has a finger-engaging section, and has the tooth extending therefrom, the second leg being elastically yieldable which allows the lightholder latch to be displaced when force is applied to the finger-engaging section so that the tooth is removed from contact with the edge of the aperture in the second position and the lightholder is removable from the magazine base in the first direction.

12. A lightholder for a handgun, comprising:

a lightholder body adapted to secure a flashlight thereon, a securing member extending outwardly from said lightholder body having a latch movable between first and second positions, a magazine base slidably receivable on a magazine in a first direction, said magazine base having a channel therein and a detent thereon, said channel receiving the securing member when the securing member is slid thereon in a second direction, said detent receiving said latch therein when said latch is in said first position and said securing member being fully inserted into said channel, and a base retainer adapted to be positioned within a magazine having a securement means for securing said magazine base on a magazine by essentially preventing movement of said magazine base in a direction opposite said first direction.

13. A method for removably securing a flashlight to a handgun, comprising the steps of:

pressing a base retainer positioned in a magazine in a first direction toward an open end of the magazine, sliding a magazine base onto a magazine in a second direction transverse of the first direction, preventing the magazine base from moving in the first direction when slid onto the magazine, inserting at least one protrusion extending from the base retainer into at least one detent in the magazine base when the magazine base is fully inserted onto the magazine, the insertion of the protrusions thereby preventing the magazine base from moving in a third direction opposite the second direction, sliding a lightholder into a guide way within the magazine base in the third direction, and removably latching a lightholder latch into a detent in the magazine base securing the lightholder against movement in the second direction.

14. The method according to claim 13, further comprising the step of selectively pressing the lightholder latch into an unlatched position so as to allow removal of the lightholder opposite the fourth direction.

15. The method according to claim 13, wherein the step of inserting the at least one protrusion includes the step of closely contacting a surface of the at least one protrusion to an edge of the at least one detent thereby preventing movement of the magazine base in the third direction during recoil created when firing the handgun.

* * * * *